US007037216B2

(12) United States Patent
Hayashi et al.

(10) Patent No.: US 7,037,216 B2
(45) Date of Patent: May 2, 2006

(54) MULTI-PIECE GOLF BALL

(75) Inventors: Junji Hayashi, Chichibu (JP); Hiroyuki Nagasawa, Chichibu (JP); Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/945,932

(22) Filed: Sep. 22, 2004

(65) Prior Publication Data

US 2006/0063611 A1 Mar. 23, 2006

(51) Int. Cl.
*A63B 37/06* (2006.01)

(52) U.S. Cl. ..... 473/377; 473/378

(58) Field of Classification Search ..... 473/376, 473/351, 373, 374, 377, 378
See application file for complete search history.

(56) References Cited

U.S. PATENT DOCUMENTS

| | | | | |
|---|---|---|---|---|
| 6,210,292 | B1 | 4/2001 | Higuchi et al. | |
| 6,244,978 | B1 | 6/2001 | Higuchi et al. | |
| 6,299,551 | B1 | 10/2001 | Higuchi et al. | |
| 6,688,992 | B1 * | 2/2004 | Takemura et al. | 473/378 |
| 2003/0013554 | A1 * | 1/2003 | Higuchi et al. | 473/371 |
| 2003/0017888 | A1 * | 1/2003 | Higuchi et al. | 473/371 |
| 2003/0125136 | A1 * | 7/2003 | Iwami | 473/378 |
| 2003/0158340 | A1 * | 8/2003 | Iwami | 525/184 |

FOREIGN PATENT DOCUMENTS

| | | | |
|---|---|---|---|
| JP | 2570587 | B2 | 5/1994 |
| JP | 2658811 | B2 | 1/1995 |
| JP | 2924720 | B2 | 1/1997 |
| JP | 2000-70408 | A | 3/2000 |
| JP | 2000-70409 | A | 3/2000 |
| JP | 2000-70410 | A | 3/2000 |
| JP | 2000-70411 | A | 3/2000 |
| JP | 2000-70414 | A | 3/2000 |

* cited by examiner

*Primary Examiner*—Raeann Gorden
(74) *Attorney, Agent, or Firm*—Sughrue Mion, PLLC

(57) ABSTRACT

Disclosed herein is a multi-piece golf ball composed of a core and an outermost cover layer, with one or more inner cover layers interposed between them, which is characterized in that the core is made mainly of a polybutadiene which is synthesized with using a catalyst of rare earth element such that the content of cis-1,4 bond is no less than 60%, the core has a diameter of 34.7 to 40.7 mm, the core undergoes deflection amounting to 3.0 to 5.0 mm under a load of 100 kg, the outermost cover layer is formed mainly of a thermoplastic resin or elastomer compounded with organic short fibers, the outermost cover layer has a Shore D hardness of 55 to 70 and a thickness of 0.5 to 2.0 mm, and the inner cover layer has a Shore D hardness of 15 to 55 and a thickness of 0.5 to 2.0 mm. The multi-piece golf ball exhibits good flying performance and crack durability. In addition, it gives the player a good striking feel at the time of putting and driver shot.

10 Claims, No Drawings

MULTI-PIECE GOLF BALL

BACKGROUND OF THE INVENTION

There have been proposed several kinds of multi-piece golf balls which are constructed of a polybutadiene-based core and a cover, with an inner cover layer interposed between them which is formed mainly from a thermoplastic resin or elastomer. Such golf balls are disclosed in Japanese Patent Nos. 2658811, 2570587, and 2924720, and Japanese Patent Laid-open Nos. Hei 12-70408, Hei 12-70409, Hei 12-70410, Hei 12-70411, and Hei 12-70414.

Conventional multi-piece golf balls are good in flying performance but poor in striking feel (especially putting feel) and crack durability. Some of them are good in durability but poor in flying performance due to excessive spin. Moreover, some of them are poor in striking sound and striking feel (when hit by a driver) because of the very soft core.

That is to say, the conventional ball exhibits poor flying performance and crack durability, and it did not give the player a good striking feel at the time of putting and driver shot.

SUMMARY OF THE INVENTION

The present invention was completed in view of the foregoing. It is an object of the present invention to provide a multi-piece golf ball which exhibits good flying performance and crack durability and gives a good feel when hit by a driver and putter.

As the result of their extensive studies, the present inventors found that the above mentioned object is achieved by a multi-piece golf ball composed of a core and an outermost cover layer, with one or more inner cover layers interposed between them, which is characterized in that the core is made mainly of a polybutadiene which is synthesized with using a catalyst of rare earth element such that the content of cis-1,4 bond is no less than 60%, the core has a diameter of 34.7 to 40.7 mm, the core undergoes deflection amounting to 3.0 to 5.0 mm under a load of 100 kg, the outermost cover layer is formed mainly of a thermoplastic resin or elastomer compounded with organic short fibers, the outermost cover layer has a Shore D hardness of 55 to 70 and a thickness of 0.5 to 2.0 mm, and the inner cover layer has a Shore D hardness of 15 to 55 and a thickness of 0.5 to 2.0 mm. The multi-piece golf ball mentioned above exhibits good flying performance with a high initial velocity, a small amount of spin, and a large hitting angle, while retaining good crack durability. In addition, it gives the player a good clicking feel (at the time of full shot by a driver) and a mild striking feel (at the time of putting and approach shot). The finding mentioned above led to the present invention.

Thus, the present invention is directed to a golf ball as defined in the following.

[1] A multi-piece golf ball composed of a core and an outermost cover layer, with one or more inner cover layers interposed between them, which is characterized in that the core is made mainly of a polybutadiene which is synthesized with using a catalyst of rare earth element such that the content of cis-1,4 bond is no less than 60%, the core has a diameter of 34.7 to 40.7 mm, the core undergoes deflection amounting to 3.0 to 5.0 mm under a load of 100 kg, the outermost cover layer is formed mainly of a thermoplastic resin or elastomer compounded with organic short fibers, the outermost cover layer has a Shore D hardness of 55 to 70 and a thickness of 0.5 to 2.0 mm, and the inner cover layer has a Shore D hardness of 15 to 55 and a thickness of 0.5 to 2.0 mm.

[2] The multi-piece golf ball of [1], wherein the outermost cover layer is made mainly of an ionomer resin.

[3] The multi-piece golf ball of [1], wherein the thermoplastic resin or elastomer for the outermost cover layer is one which does not increase in Shore D hardness more than 3 before and after blending with organic short fibers.

[4] The multi-piece golf ball of [1], wherein the outermost cover layer is made mainly of a resin compound which is a mixture of component (a) which is selected from olefin-unsaturated carboxylic acid copolymer, olefin-unsaturated carboxylic acid-unsaturated carboxylic ester copolymer, and their salt neutralized with metal ions, and component (b) which is a binary copolymer composed of a polyolefin component and a polyamide component.

[5] The multi-piece golf ball of [4], wherein the polyamide component in component (b) is nylon fibers.

[6] The multi-piece golf ball of [1], wherein the inner cover layer is made mainly of a thermoplastic elastomer of non-ionomer type.

[7] The multi-piece golf ball of [4], wherein the inner cover layer is made mainly of a thermoplastic polyester elastomer.

[8] The multi-piece golf ball of [1], wherein the polybutadiene for the core contains sulfur.

Incidentally, the term "mainly" means that the material constituting the core, inner cover layer, and outermost cover layer accounts for no less than 50 wt %, particularly 60 to 100 wt %, of the total amount of the materials.

DETAILED DESCRIPTION OF THE INVENTION

The invention will be described in more detail in the following.

The present invention is embodied in a multi-piece solid golf ball consisting of a core and an outermost cover layer, with one or more inner cover layers interposed between them. The core may be formed from a polybutadiene-based rubber compound compounded with a co-cross linking agent, organic peroxide, inert filler, organosulfur compound, and the like.

The polybutadiene should preferably be one which has cis-1,4-bonds in the polymer chain accounting for no less than 60 wt %, preferably no less than 80 wt %, more preferably no less than 90 wt %, and most desirably no less than 95 wt %. With an excessively low content of cis-1,4-bonds in the molecule, the resulting polybutadiene will be poor in rebound resilience.

In addition, the polybutadiene should preferably be one which has 1,2-vinyl bonds in the polymer chain accounting for less than or equal to 2%, preferably less than or equal to 1.7%, and more preferably less than or equal to 1.5%. With an excessively high content of 1,2-vinyl bonds in the molecule, the resulting polybutadiene will be poor in rebound resilience.

The polybutadiene mentioned above should preferably be one which is synthesized with using a catalyst of rare earth element, so that the polybutadiene-based rubber compound exhibits good rebound resilience after vulcanization.

The above-mentioned catalyst of rare earth element is not specifically restricted. It may be a compound of lanthanoid rare earth element combined with an organoaluminum compound, alumoxane, halogen-containing compound, and Lewis base (optional).

The compound of lanthanoid rare earth element may be in the form of halide, carboxylate, alcoholate, thioalcoholate, or amide of a metal with an atomic number 57 to 71.

Of the catalyst of lanthanoid rare earth element mentioned above, that of neodymium compound is desirable because it effectively yields polybutadiene with a high content of 1,4-cis bonds and a low content of 1,2-vinyl bonds. Its examples are disclosed in Japanese Patent Laid-open Nos. Hei 11-35633, Hei 11-164912, and 2002-293996.

The polybutadiene synthesized with using a catalyst of lanthanoid rare earth element should account for no less than 10 wt %, preferably no less than 20 wt %, particularly no less than 40 wt %, of the total amount of the rubber compound for improved rebound resilience.

Incidentally, the base material of the rubber compound mentioned above may contain, in addition to the polybutadiene mentioned above, any other rubber components insofar as the effects of the invention are not compromised. Such additional rubber components include polybutadiene (excluding the one mentioned above), diene rubber (such as styrene-butadiene rubber), natural rubber, isoprene rubber, and ethylene-propylene-diene rubber.

Examples of the co-crosslinking agent include unsaturated carboxylic acids and metal salts thereof.

Examples of unsaturated carboxylic acids include acrylic acid, methacrylic acid, maleic acid, and fumaric acid. Preferable among them are acrylic acid and methacrylic acid.

Metal salts of unsaturated carboxylic acids may be exemplified by those which are obtained by neutralizing the above-mentioned unsaturated carboxylic acid with specific metal ions. They include, without specific restrictions, a zinc or magnesium salt of acrylic acid or methacrylic acid. Preferable among them is zinc acrylate.

The amount of the unsaturated carboxylic acid and/or metal salt thereof to be compounded into 100 pbw of the base rubber should be no less than 10 pbw, preferably no less than 15 pbw, more preferably no less than 20 pbw, and less than or equal to 60 pbw, preferably less than or equal to 50 pbw, more preferably less than or equal to 45 pbw, most desirable less than or equal to 40 pbw. An excessively large amount will lead to a very poor striking feel owing to excessive hardness; and an excessively small amount will lead to low rebound resilience.

The organic peroxide mentioned above may be selected from commercial products, such as Percumyl D and Perhexa 3M (both from NOF Corporation) and Luperco 231XL (from Elf Atochem). They may be used alone or in combination with one another.

The amount of the organic peroxide to be compounded into 100 pbw of the base rubber should be no less than 0.05 pbw, preferably no less than 0.1 pbw, more preferably no less than 0.2 pbw, most desirably no less than 0.3 pbw, and less than or equal to 5 pbw, preferably less than or equal to 4 pbw, more preferably less than or equal to 3 pbw, most desirably less than or equal to 2 pbw. An excessively large or small amount will lead to poor striking feel, poor durability, and low rebound resilience.

The inert filler includes, for example, zinc oxide, barium sulfate, and calcium carbonate. They may be used alone or in combination with one another.

The amount of the inert filler to be compounded into 100 pbw of the base rubber should be no less than 1 pbw, preferably no less than 5 pbw, and less than or equal to 50 pbw, preferably less than or equal to 40 pbw, more preferably less than or equal to 30 pbw, most desirably less than or equal to 20 pbw. An excessively large or small amount will lead to golf balls with an improper weight or low rebound resilience.

The rubber compound may optionally be compounded with an antioxidant, which is selected from commercial products, such as Nocrac NS-6 and NS-30 (from Ouchi-shinko Chemical Industrial Co., Ltd.), and Yoshinox 425 (from Yoshitomi Pharmaceutical Industries, Ltd.). They may be used alone or in combination with one another.

The amount of the antioxidant to be compounded into 100 pbw of the base rubber should be no less than 0 pbw, preferably no less than 0.05 pbw, more preferably no less than 0.1 pbw, most desirably no less than 0.2 pbw, and less than or equal to 3 pbw, preferably less than or equal to 2 pbw, more preferably less than or equal to 1 pbw, most desirably less than or equal to 0.5 pbw. An excessively large or small amount will lead to golf balls with poor durability and low rebound resilience.

The core mentioned above should preferably be compounded with an organosulfur compound so that the resulting golf ball has improved rebound resilience and an increased initial velocity.

The organosulfur compound is not specifically restricted so long as it contributes to the rebound resilience of the golf ball. It includes thiophenols, thionaphthols, halogenated thiophenols (or metal salts thereof), and polysulfides with 2 to 4 sulfur atoms.

Their typical examples are pentachlorothiophenol, pentafluorothiophenol, pentabromothiophenol, p-chlorothiophenol, and their zinc salts; and diphenylpolysulfide, dibenzylpolysulfide, dibenzoylpolysulfide, dibenzothiazoylpolysulfide, and dithiobenzoylpolysulfide, which have 2 to 4 sulfur atoms. Preferable among them are zinc salt of pentachlorothiophenol and diphenyldisulfide.

The amount of the organosulfur compound to be compounded into 100 pbw of the base rubber should be no less than 0.05 pbw, preferably no less than 0.1 pbw, and less than or equal to 5 pbw, preferably less than or equal to 4 pbw, more preferably less than or equal to 3 pbw, most desirably less than or equal to 2.5 pbw. An excessively large amount will lead the plateau in effect. An excessively small amount does not produce its effect.

The core should preferably be compounded with sulfur in addition to the organosulfur compound mentioned above. Sulfur increases difference in hardness between the core center and the core surface. This produces the effect of reducing the amount of spin and increasing the angle of hitting, thereby extending flying distance. The amount of sulfur to be compounded into 100 pbw of the base rubber should preferably be 0.05 to 5 pbw, particularly 0.1 to 4 pbw.

The core should be formed such that it has a diameter no smaller than 34.7 mm, preferably no smaller than 35.7 mm, more preferably no smaller than 37.0 mm, and no larger than 40.7 mm, preferably no larger than 39.7 mm, more preferably no larger than 38.7 mm.

The core should be formed such that it undergoes deflection (under a load of 100 kg) which is no less than 3.0 mm, preferably no less than 3.2 mm, more preferably no less than 3.4 mm, and less than or equal to 5.0 mm, preferably less than or equal to 4.5 mm, more preferably less than or equal to 4.2 mm. With an excessively small value of deflection, the core results in a hard striking feel and a short flying distance due to excessive spin. With an excessively large value of deflection, the core results in a soft striking feel and a short flying distance due to low rebound resilience and also leads to poor crack durability.

The core should be formed such that its surface has a Shore D hardness of 40 to 65, preferably 42 to 63, more preferably 45 to 60, and its center has a Shore D hardness of 30 to 50, preferably 32 to 48, more preferably 35 to 45. Incidentally, the value of Shore D hardness is one which is obtained by measurement with a type D durometer according to ASTM D2240. With an excessively high hardness, the core results in a very hard striking feel and an excess amount of spin which causes the golf ball to follow a sharp trajectory with a short flying distance. With an excessively low hardness, the core results in a very soft striking feel and a very low rebound resilience (which leads to a short flying distance).

The hardness of the core surface and the hardness of the core center (both in terms of Shore D hardness) should be such that their difference is 4 to 30, preferably 7 to 25, more preferably 10 to 20. If the difference in hardness is larger than specified above, the resulting golf ball is poor in resistance to repeated hitting. If the difference in hardness is smaller than specified above, the resulting golf ball experiences a large amount of spin at the time of driver shot (W#1), which leads to a reduced flying distance.

The outermost cover layer mentioned above is formed mainly from a thermoplastic resin or elastomer compounded with organic short fibers. The composite material contributes to improved resistance to crack durability. It is not specifically restricted in its composition. It should preferably be the resin composite material mixed of component (a) which is selected from olefin-unsaturated carboxylic acid copolymer, olefin-unsaturated carboxylic acid-unsaturated carboxylic ester copolymer, and their salt neutralized with metal ions, and component (b) which is a binary copolymer composed of a polyolefin component and a polyamide component.

The component (a) mentioned above should be selected from olefin-unsaturated carboxylic acid binary random copolymer and olefin-unsaturated carboxylic acid-unsaturated carboxylic ester ternary random copolymer and their salt neutralized with metal ions. The olefin in the copolymer mentioned above should preferably be one which has a carbon number of 2 or more and 8 or less, particularly 6 or less. Its typical examples include ethylene, propylene butene, pentene, hexene, heptene, and octene. Preferable among them is ethylene.

Examples of the unsaturated carboxylic acid include acrylic acid, methacrylic acid, maleic acid, and fumaric acid. Preferable among them are acrylic acid and methacrylic acid.

The unsaturated carboxylic ester should preferably be the lower alkyl ester of unsaturated carboxylic acid mentioned above. Its typical examples include methyl methacrylate, ethyl methacrylate, propyl methacrylate, and butyl methacrylate, methyl acrylate, ethyl acrylate, propyl acrylate, and butyl acrylate. Preferable among them are n-butyl acrylate and i-butyl acrylate.

The above-mentioned component (a), which is either olefin-unsaturated carboxylic acid binary random copolymer or olefin-unsaturated carboxylic acid-unsaturated carboxylic ester ternary random copolymer, may be obtained by any known method of random copolymerization from the above-mentioned raw materials.

The above-mentioned random copolymer should be one which contains an unsaturated carboxylic acid in an adequately controlled amount. The amount of the unsaturated carboxylic acid contained in the component (a) should be no less than 4 wt %, preferably no less than 6 wt %, more preferably no less than 8 wt %, most desirably no less than 10 wt %, and less than or equal to 30 wt %, preferably less than or equal to 20 wt %, more preferably less than or equal to 18 wt %, most desirably less than or equal to 15 wt %.

The above-mentioned component (a), which is either olefin-unsaturated carboxylic acid binary random copolymer or olefin-unsaturated carboxylic acid-unsaturated carboxylic ester ternary random copolymer, may be obtained by partly neutralizing acid groups in the random copolymer with metal ions. This component will be referred to as a metal ion neutralized product of random copolymer hereinafter.

Metal ions to neutralize acid groups include, for example, $Na^+$, $K^+$, $Li^+$, $Zn^{++}$, $Cu^{++}$, $Mg^{++}$, $Ca^{++}$, $Co^{++}$, $Ni^{++}$, and $Pb^{++}$. Of these examples, $Na^+$, $Li^+$, $Zn^{++}$, and $Mg^{++}$ are preferable, and $Zn^{++}$ are most desirable.

The metal ion neutralized product of random copolymer may be obtained by neutralizing the random copolymer with metal ions specified above. The metal ions may be in the form of formate, acetate, nitrate, carbonate, hydrogen carbonate, oxide, hydroxide, or alkoxide. There are no specific restrictions in the degree of neutralization of the random copolymer with metal ions.

According to the present invention, the metal ion neutralized product of random copolymer should preferably be an ionomer resin neutralized with zinc ions. This ionomer permits easy control of melt flow rate for improved moldability.

The component (a) mentioned above may be selected from commercial ones. Commercial binary random copolymers are Nucrel 1560, 1214, and 1035 (all from Du Pont-Mitsui Polychemicals Co., Ltd.) and Escor 5200, 5100, and 5000 (all from ExxonMobil Chemical). Commercial ternary random copolymers are Nucrel AN4311 and AN4318 (both from Du Pont-Mitsui Polychemicals Co., Ltd.) and Escor ATX325, ATX320, and ATX310 (all from ExxonMobil Chemical).

The metal ion neutralized product of binary random copolymer is commercially available under the trade name of Himilan 1554, 1557, 1601, 1605, 1706, and AM7311 (all from Du Pont-Mitsui Polychemicals Co., Ltd.), Surlyn 7930 (from Du Pont in USA), and Ioteck 3110 and 4200 (both from ExxonMobil Chemical). The metal ion neutralized product of ternary random copolymers is commercially available under the name of Himilan 1855, 1856 and AM7316 (all from Du Pont-Mitsui Polychemicals Co., Ltd.), Surlyn 6320, 8320, 9320 and 8120 (all from Du Pont in USA), and Ioteck 7510 and 7520 (both from ExxonMobil Chemical). Of these commercial produces, Himilan 1706, 1557, and AM7316 are preferable, which are zinc-neutralized ionomer resins.

On the other hand, the component (b), which is a polyolefin, should preferably be any of low-density polyethylene (LDPE), high-density polyethylene (HDPE), polypropylene, and polystyrene. Preferable among them is polyethylene, particularly low-density polyethylene with a high crystallinity.

The polyamide component should be selected from nylon 6, nylon 66, nylon 11, nylon 12, nylon 610, nylon 612, copolymer nylon, nylon MXD6, nylon 46, aramide, polyamideimide, and polyimde. Of these products, nylon 6 is desirable because of its balanced price and physical properties. The polyamide component should be in the form of fiber. Nylon fiber is particularly desirable. The nylon fiber should have an average diameter no larger than 10 μm, preferably no larger than 5 μm, more preferably no larger than 1 μm, and no smaller than 0.01 μn. Such fine fibers efficiently produce the reinforcing effect. Incidentally, the average diameter is one which is measured by observing the cross section of samples under a transmission electron microscope.

The component (b) mentioned above should be in the form of composite material having a crystalline polyolefin component bonding to the surface of nylon fiber. The term "bonding" means that the polyamide component and the polyolefin component bind together through grafting with the help of a binder. Examples of the binder include silane coupling agents, titanate coupling agents, unsaturated carboxylic acids and derivatives thereof, and organic peroxides.

The component (b) mentioned above should contain the polyolefin component (b-1) and the polyamide component (b-2) such that the ratio of (b-1)/(b-2) by weight is from 25/75 to 95/5, preferably from 30/70 to 90/10, more preferably from 40/60 to 75/25. With an excessively small amount, the polyamide component will not fully produce the reinforcing effect. With an excessively large amount, the polyamide component will not mix well with the component (a) at the time of kneading in a twin-screw extruder or the like.

The components (a) and (b) mentioned above should be mixed with each other such that the ratio (a)/(b) by weight is from 100/0.1 to 100/50, preferably from 100/1 to 100/40, more preferably from 100/2 to 100/30. With an excessively small amount, the component (b) will not fully produce its effect. With an excessively large amount, the component (b) impairs mixing and molding into the cover.

The mixing temperature for the components (a) and (b) should be higher than the melting point of the polyolefin component, preferably by more than 10° C., and lower than the melting point of the polyamide component, preferably by more than 10° C., so that the polyamide component retains its shape as much as possible. This is not necessarily mandatory.

The molding into golf balls should be accomplished at a stock temperature within the above-mentioned temperature range, although this is not necessarily mandatory.

The resin compound composed essentially of the components (a) and (b) may optionally be compounded with a variety of additives, such as pigment, dispersing agent, antioxidant, UV light absorber, UV light stabilizer, mold release, plasticizer, and inorganic filler (including zinc oxide, barium sulfate, and titanium dioxide). The total amount of the components (a) and (b) in the resin compound should be no less than 30 wt %, preferably from 60 to 100 wt %.

The outermost cover layer formed from the resin compound should have a Shore D hardness no lower than 55, preferably no lower than 57, more preferably no lower than 61, and no higher than 70, preferably no higher than 68, more preferably no higher than 66. If the hardness is excessively low, the resulting golf ball is poor in flying distance due to low rebound resilience or excess spin. If the hardness is excessively high, the resulting golf ball is poor in striking feel and resistance to repeated hitting. Incidentally, the value of Shore D hardness is one which is obtained by measurement of a type D durometer according to ASTM D2240.

The thermoplastic resin or the thermoplastic elastomer for the outermost cover layer should not increase in Shore D hardness by more than 3, particularly by more than 1, before and after blending with organic short fibers. Otherwise, the resulting golf ball will be poor in flying distance due to excessive spin.

The outermost cover layer should have a thickness no smaller than 0.5 mm, preferably no smaller than 1.0 mm, more preferably no smaller than 1.2 mm, and no larger than 2.0 mm, preferably no larger than 1.8 mm, more preferably no larger than 1.5 mm. With an excessively thin outermost cover layer, the resulting golf ball is poor in resistance to repeated hitting. With an excessively thick outermost layer, the resulting golf ball does not give a soft striking feel at the time of putting and approach shot and is poor in flying distance due to excessive spin.

According to the present invention, the core and the outermost cover layer are separated from each other by one or more inner cover layers. The inner cover layers may be formed from any known thermoplastic resin or elastomer. A thermoplastic elastomer of non-ionomer type is desirable for good striking feel and improved rebound resilience.

Examples of the thermoplastic elastomer of non-ionomer type include olefin elastomer, styrene elastomer, polyester elastomer, urethane elastomer, and polyamide elastomer. Preferable among them is polyester elastomer, which is commercially available under the trade name of Hytrel (from Du Pont-Toray Co., Ltd.). They may be used alone or in combination with one another.

The inner cover layer should have a Shore D hardness no lower than 15, preferably no lower than 20, more preferably no lower than 30, and no higher than 55, preferably no higher than 50, more preferably no higher than 40. If the hardness is excessively high, the resulting golf ball lacks a soft striking feel at the time of putting and approach shot. Incidentally, the value of Shore D hardness is one which is obtained by measurement of a type D durometer according to ASTM D2240.

The inner cover layer should have a thickness no smaller than 0.5 mm, preferably no smaller than 0.7 mm, more preferably no smaller than 1.0 mm, and no larger than 2.0 mm, preferably no larger than 1.8 mm, more preferably no larger than 1.5 mm. With an excessively thin inner cover layer, the resulting golf ball lacks a soft striking feel at the time of putting and approach shot. With an excessively thick inner layer, the resulting golf ball is poor in flying distance due to excessive spin.

The golf ball according to the present invention may have dimples formed by any known method. In addition, it may be formed in such a way that it has a diameter no smaller than 42.67 mm, preferably 42.67 to 43.00 mm, and a weight of 45.0 to 45.93 g. There are no specific restrictions in the manufacturing method. The core, inner cover layer and outermost cover layer may be formed by any known method, such as compression molding and injection molding.

EXAMPLES

The invention will be described in more detail with reference to the following examples and comparative examples, which are not intended to restrict the scope thereof.

Examples 1 to 6 and Comparative Examples 1 to 6

A rubber compound for the core was prepared according to the formulation shown in Table 1. In each example (excluding Example 3) and comparative example, a solid core was molded by vulcanization at 155° C. for 15 minutes. In Example 3, vulcanization was carried out at 165° C. for 15 minutes. The resulting solid core was examined for surface hardness and center hardness according to ASTM D2240 (Shore D hardness). Resin compounds for the inner cover layer and the outermost cover layer were prepared according to the formulation shown in Table 2. The rubber compound and resin compounds underwent injection molding to give a three-piece solid golf ball as specified in Table 3.

TABLE 1

| | Example | | | | | | Comparative Example | | | | | |
|---|---|---|---|---|---|---|---|---|---|---|---|---|
| | 1 | 2 | 3 | 4 | 5 | 6 | 1 | 2 | 3 | 4 | 5 | 6 |
| Polybutadiene | | | | | | | | | | | | |
| BR730 | 100 | 100 | 95 | 100 | 100 | 100 | | | | | | |
| BR01 | | | | | | | 50 | 50 | 50 | 50 | 50 | 50 |
| BR11 | | | | | | | 50 | 50 | 50 | 50 | 50 | 50 |
| Polyisoprene | | | | | | | | | | | | |
| IR2200 | | | 5 | | | | | | | | | |
| Peroxide | | | | | | | | | | | | |
| Perhexa 3M-40 | 0.3 | 0.3 | 0.1 | 0.3 | 0.3 | 0.3 | 0.6 | 0.6 | 0.6 | 0.6 | 0.6 | 0.6 |
| percumyl D | 0.3 | 0.3 | 0.1 | 0.3 | 0.3 | 0.3 | 0.6 | 0.6 | 0.6 | 0.6 | 0.6 | 0.6 |
| Antioxidant | | | | | | | | | | | | |
| Nocrac NS-6 | 0.1 | 0.1 | | 0.1 | 0.1 | 0.1 | 0.1 | 0.1 | 0.1 | 0.1 | 0.1 | 0.1 |
| Zinc oxide | 21.9 | 23.1 | 14.7 | 23.0 | 24.2 | 19.8 | 29.8 | 23.1 | 20.8 | 30.0 | 33.1 | 15.3 |
| Sulfur | | | 4 | | | | | | | | | |
| Zinc acrylate | 29.3 | 26.3 | 39.0 | 29.2 | 26.1 | 29.6 | 25.5 | 26.3 | 31.9 | 28.4 | 17.8 | 30.0 |
| Zinc stearate | 5 | 5 | 5 | 5 | 5 | 5 | 5 | 5 | 5 | 5 | 5 | 5 |
| Zinc salt of pentachlorothiophenol | 1 | 1 | 3 | 1 | 1 | 1 | 1 | 1 | 1 | 1 | 1 | 1 |

Note: Expressed in terms of parts by weight.

The materials and trade names shown in Table 1 are specified as follows.

Polybutadiene BR730:

Nd catalyst, 96% cis-1,4-bonds, from JSR Corporation.

Polybutadiene BR01:

Ni catalyst, 96% cis-1,4-bonds, from JSR Corporation.

Polybutadiene BR11:

Ni catalyst, 96% cis-1,4-bonds, from JSR Corporation.

Polyisoprene IR2200:

98% cis-1,4-bonds, from JSR Corporation.

Percumyl D: dicumyl peroxide from NOF Corporation.

Perhexa 3M-40:

1,1-bis(t-butylperoxy)-3,5,5-trimethylcyclohexane, from NOF Corporation.

Antioxidant, Nocrac NS-6:

from Ouchishinko Chemical Industrial Co., Ltd.

TABLE 2

| | Example | | | | | | Comparative Example | | | | | |
|---|---|---|---|---|---|---|---|---|---|---|---|---|
| | 1 | 2 | 3 | 4 | 5 | 6 | 1 | 2 | 3 | 4 | 5 | 6 |
| Inner cover layer | | | | | | | | | | | | |
| Hytrel 4047 | 100 | 100 | 100 | | | 100 | 100 | 100 | 100 | | | 100 |
| Hytrel 3046 | | | | 100 | 100 | | | | | | | |
| Himilan 1557 | | | | | | | | | | 50 | 50 | |
| Himilan 1601 | | | | | | | | | | 50 | 50 | |
| Outermost cover layer | | | | | | | | | | | | |
| Himilan 1557 | | | | | | 50 | | | | | | |
| Himilan 1555 | | | | | | 50 | | | | | | |
| Himilan 1706 | 25 | 25 | 25 | 25 | 25 | | 50 | 50 | 50 | 50 | 50 | |
| Himilan 1605 | 50 | 50 | 50 | 50 | 50 | | 50 | 50 | 10 | 50 | 50 | |
| Surlyn 7930 | | | | | | | | | | | | 65 |
| Surlyn 6320 | | | | | | | | | | | | 35 |
| Surlyn 8320 | | | | | | | | | 40 | | | |
| Surlyn 9945 | 25 | 25 | 25 | 25 | 25 | | | | | | | |
| Polyolefin/polyamide binary copolymer | 5 | 5 | 5 | 5 | 5 | 5 | | | | | | |
| Barium sulfate 300 | | | | | | | | | | | | 15 |
| Titanium oxide | 2 | 2 | 2 | 2 | 2 | 2 | 2 | 2 | 2 | 2 | 2 | 5 |
| Magnesium stearate | 1 | 1 | 1 | 1 | 1 | 1 | 1 | 1 | 1 | 1 | 1 | 1 |

Note: Expressed in terms of parts by weight.

The materials and trade names shown in Table 2 are specified as follows.

"Hytrel" series:

Thermoplastic polyester elastomer, from Du Pont-Toray Co., Ltd.

"Surlyn" series: Ionomer resin, from Du Pont in USA.

"Himilan" series:

Ionomer resin, from Du Pont-Mitsui Polychemicals Co., Ltd.

Polyolefin/polyamide binary copolymer:

"LA0010" from Daiwa Polymer, a 50/50 mixture (by weight) of low-density polyethylene and polyamide (nylon 6) short fibers.

Barium sulfate 300:

a product of SAKAI CHEMICAL INDUSTRY CO., LTD.

This is the hardness of the core surface, which is measured by using a type D durometer according to ASTM D2240.

Ball diameter:

This is the diameter measured at the ball surface where there is no dimple.

Thickness of outermost cover layer and inner cover layer:

TABLE 3

| | Example | | | | | | Comparative Example | | | | | |
|---|---|---|---|---|---|---|---|---|---|---|---|---|
| | 1 | 2 | 3 | 4 | 5 | 6 | 1 | 2 | 3 | 4 | 5 | 6 |
| Core | | | | | | | | | | | | |
| Diameter (mm) | 37.2 | 37.2 | 37.2 | 37.7 | 37.7 | 37.7 | 35.0 | 37.2 | 37.2 | 36.7 | 36.7 | 37.7 |
| Deflection (mm) | 3.4 | 4.0 | 3.4 | 3.4 | 4.0 | 3.4 | 4.0 | 4.0 | 2.9 | 3.4 | 5.5 | 3.4 |
| Center hardness (Shore D) | 42.6 | 39.7 | 41.3 | 43.0 | 40.1 | 42.5 | 39.5 | 39.8 | 45.6 | 42.6 | 32.0 | 42.4 |
| Surface hardness (Shore D) | 50.3 | 47.6 | 57.2 | 50.0 | 47.2 | 50.5 | 47.8 | 47.6 | 52.6 | 50.5 | 36.0 | 50.6 |
| Surface-Center (Shore D) | 7.7 | 7.9 | 15.9 | 7.0 | 7.1 | 8.0 | 8.3 | 7.8 | 7.0 | 7.9 | 4.0 | 8.2 |
| Inner cover layer | | | | | | | | | | | | |
| Diameter (mm) | 39.7 | 39.7 | 39.7 | 39.7 | 39.7 | 40.2 | 38.6 | 39.7 | 39.7 | 39.7 | 39.7 | 40.2 |
| Thickness (mm) | 1.25 | 1.25 | 1.25 | 1.00 | 1.00 | 1.25 | 1.80 | 1.25 | 1.25 | 1.50 | 1.50 | 1.25 |
| Hardness (Shore D) | 40 | 40 | 40 | 30 | 30 | 40 | 40 | 40 | 40 | 60 | 60 | 40 |
| Outermost cover layer | | | | | | | | | | | | |
| Thickness (mm) | 1.50 | 1.50 | 1.50 | 1.50 | 1.50 | 1.25 | 2.05 | 1.50 | 1.50 | 1.50 | 1.50 | 1.25 |
| Hardness (Shore D) | 63 | 63 | 63 | 63 | 63 | 60 | 63 | 63 | 47 | 63 | 63 | 60 |
| Base resin hardness | 63 | 63 | 63 | 63 | 63 | 60 | 63 | 63 | 47 | 63 | 63 | 56 |
| Ball | | | | | | | | | | | | |
| Diameter (mm) | 42.7 | 42.7 | 42.7 | 42.7 | 42.7 | 42.7 | 42.7 | 42.7 | 42.7 | 42.7 | 42.7 | 42.7 |
| Weight (g) | 45.3 | 45.3 | 45.3 | 45.3 | 45.3 | 45.3 | 45.3 | 45.3 | 45.3 | 45.3 | 45.3 | 45.3 |
| Deflection (mm) | 2.9 | 3.4 | 2.9 | 2.9 | 3.4 | 3.1 | 3.0 | 3.4 | 2.9 | 2.1 | 3.2 | 3.1 |
| Flying performance, W#1, HS 42 | | | | | | | | | | | | |
| Spin (rpm) | 2795 | 2650 | 2695 | 2850 | 2700 | 2890 | 2820 | 2660 | 3400 | 2950 | 2830 | 3050 |
| Initial velocity (m/s) | 61.0 | 60.8 | 60.9 | 60.9 | 60.7 | 60.8 | 60.5 | 60.3 | 59.9 | 60.9 | 60.4 | 60.1 |
| Flying distance (m) | 214.6 | 214.1 | 215.2 | 213.9 | 213.8 | 213.0 | 211.8 | 211.6 | 205.5 | 213.0 | 211.4 | 208.0 |
| Crack durability | 157 | 124 | 135 | 146 | 113 | 146 | 99 | 96 | 200 and up | 200 and up | 200 and up | 148 |
| Striking feel | | | | | | | | | | | | |
| Driver | ○ | ○ | ○ | ○ | ○ | ○ | ○ | ○ | ○ | x | Δ | ○ |
| Putting | ○ | ○ | ○ | ○ | ○ | ○ | Δ | ○ | ○ | x | x | ○ |

Note:

Deflection of core and ball:

Amount of defection under a load of 100 kg.

Shore D hardness of outermost cover layer and inner cover layer:

Values of hardness measured with a type D durometer according to ASTM D2240. Specimens in sheet form were prepared from each material.

Base resin hardness:

Values of hardness measured in the same way as above, before incorporation with organic short fibers and barium sulfate, etc.

Core center hardness (Shore D hardness):

This is the hardness measured at the center of the cross section along which the ball is cut half. Measurement is carried out by using a type D durometer according to ASTM D2240.

Core surface hardness (Shore D hardness):

Expressed in terms of half the difference in diameter measured for the sphere before and after covering with the inner cover layer and subsequently with the outermost cover layer.

The thus obtained golf balls were examined for flying performance, crack durability, and striking feel in the following manner. The results are shown in Table 3.

Flying Performance:

Each ball sample was tested for flying performance by measuring the total flying distance which it traveled when it was hit at a head speed (HS) of 42 m/s by a driver attached to a swing robot made by Miyamae Co., Ltd. (The driver is X-Drive Type 300, Prospec, with a loft angle of 10°, made by Bridgestone Sports Co., Ltd.) The spin and initial velocity were measured immediately after hitting by using a high-speed camera.

Crack Durability:

Each ball sample was tested for crack durability by counting the number of hitting required for the ball to crack when the ball was repeatedly hit against a steel plate at an initial velocity of 43 m/s. The results are expressed in terms of relative value, with the reference value being 100. The reference value is the number of hitting required for the commercial golf ball (ALTUS NEWING) to crack.

Striking Feel:

Each ball sample was evaluated by five skilled amature golfers (with a handicap less than 10). The striking feel was rated according to the following criterion, and the result is expressed in terms of average in three levels.

5 points: very good
4 points: good
3 points: mediocre
2 points: poor
1 point: bad
○: An average more than 4 points.
Δ: An average of 2 to 4 points.
x: An average less than 2 points.

It is noted from Table 3 that the samples according to the present invention are superior in flying performance, crack durability, and striking feel for putter and driver. By contrast, the sample in Comparative Example 1, which has a harder, thicker outermost cover layer, is poor in striking feel for putting. Moreover, the sample in Comparative Example 1, which has the outermost cover layer not containing organic short fibers, is poor in crack durability. Likewise, the sample in Comparative Example 2, which has the outermost cover layer not containing organic short fibers, is poor in crack durability. The sample in Comparative Example 3, which has a soft cover, is poor in flying performance due to excess spin. The sample in Comparative Example 4, which has a high hardness, is poor in striking feel, particularly that for putting. The sample in Comparative Example 5, which has a very soft core, lacks click feel at the time of driver shot and is poor in hitting sound and striking feel, particularly that for putting. The sample in Comparative Example 6 is good in crack durability but is poor in flying performance due to excessive spin (which results from the soft base resin).

The samples in Comparative Examples 1, 2, 3, 5, and 6 are poor in flying performance with a low initial velocity because their cores are not formed from the polybutadiene polymerized with using catalyst of rare earth element.

The invention claimed is:

1. A multi-piece golf ball composed of a core and an outermost cover layer, with one or more inner cover layers interposed between them, which is characterized in that said core is made mainly of a polybutadiene which is synthesized with using a catalyst of rare earth element such that the content of cis-1,4 bond is no less than 60%, said core has a diameter of 34.7 to 40.7 mm, said core undergoes deflection amounting to 3.0 to 5.0 mm under a load of 100 kg, said outermost cover layer is made mainly of a resin compound which is a mixture of component (a) which is selected from olefin-unsaturated carboxylic acid copolymer, olefin-unsaturated carboxylic acid-unsaturated carboxylic ester copolymer, and their salt neutralized with metal ions, and component (b) which is a binary copolymer composed of a polyolefin component (b-1) and a polyamide component (b-2), said outermost cover layer has a Shore D hardness of 55 to 70 and a thickness of 0.5 to 2.0 mm, and said inner cover layer has a Shore D hardness of 15 to 55 and a thickness of 0.5 to 2.0 mm.

2. The multi-piece golf ball of claim 1, wherein the blending of component (b) into component (a) for the outermost cover layer is controlled such that an increase in a Shore D hardness of the outermost cover after blending when compared to a Shore D hardness of the thermoplastic resin or elastomer before blending is 3 or less.

3. The multi-piece golf ball of claim 1, wherein the polyamide component in component (b) is nylon fibers.

4. The multi-piece golf ball of claim 1, wherein the inner cover layer is made mainly of a thermoplastic elastomer of non-ionomer type.

5. The multi-piece golf ball of claim 1, wherein the inner cover layer is made mainly of a thermoplastic polyester elastomer.

6. The multi-piece golf ball of claim 1, wherein the polybutadiene for the core contains sulfur.

7. The multi-piece golf ball of claim 1, wherein the core is formed such that its surface has a Shore D hardness of 40 to 65, and its center has a Shore D hardness of 30 to 50, and the hardness of the core surface is larger than the hardness of the core center with a Shore D hardness difference of 4 to 30.

8. The multi-piece golf ball of claim 1, wherein the ratio of (b-1)/(b-2) by weight of polyolefin component (b-1) and the polyamide component (b-2) is from 25/75 to 95/5.

9. The multi-piece golf ball of claim 1, wherein the ratio (a)/(b) by weight of the component (a) and the component (b) is from 100/0.1 to 100/50.

10. The multi-piece golf ball of claim 1, wherein the component (b) is in the form of composite material having a crystalline polyolefin component bonding to a surface of nylon fiber.

* * * * *